US005324139A

United States Patent [19]

Wagner et al.

[11] Patent Number: 5,324,139

[45] Date of Patent: Jun. 28, 1994

[54] METHOD FOR THE CONSTRUCTION OF LONG TUNNEL WITH A LINING

[75] Inventors: Harald Wagner, Mauthausen; Alfred Schulter; Helmut Pfeil, both of Linz; Otto Schubert, Vienna, all of Austria

[73] Assignees: Ingenieure Mayreder, Kraus & Co. Consult Gesellschaft m.b.H., Linz; Tunnel Aktiengesellschaft Tunnel Planungs-, Errichtungs- und Betriebs-Aktiengesellschaft, Vienna, both of Austria; a part interest

[21] Appl. No.: 19,246

[22] Filed: Feb. 18, 1993

[30] Foreign Application Priority Data

Feb. 21, 1992 [AT] Austria ..... A324/92

[51] Int. Cl.[5] ..... E21D 9/06; E21D 11/04

[52] U.S. Cl. ..... 405/146; 405/150.1; 405/153

[58] Field of Search ..... 405/146, 150.1, 151, 405/152, 153

[56] References Cited

U.S. PATENT DOCUMENTS 4,652,174 3/1987 Cornely et al. ..... 405/146
4,812,084 3/1989 Wagner et al. ..... 405/153

FOREIGN PATENT DOCUMENTS 389149 10/1989 Austria .
2101092 8/1972 Fed. Rep. of Germany .

*Primary Examiner*—David H. Corbin
*Attorney, Agent, or Firm*—Collard & Roe

[57] ABSTRACT

A new combination of means and method steps is used in a method of constructing long tunnels with a lining, wherein excavation is effected with a tunnel boring machine (1) with a yielding shield mantle (4), building is effected continuously under the protection of the shield tail in a modular construction with tubbing stones of a special form complementing each other to form tubbing rings (15) while, until a new equilibrium of the rock formation is reached, occurring deformation forces are absorbed by the shield tail (4) and the tubbing rings which are yieldingly constructed to a limited degree, an outer seal of the tubes is provided and the gap between the excavation (2) and the tunnel tubes is filled with a material (22) which may be yielding to a limited extent to absorb long-time deformation forces. A tunnel construction made by the method, special forms of tubbing stones and new embodiments of drive means for the tunnel are disclosed.

15 Claims, 4 Drawing Sheets

Figure 5:
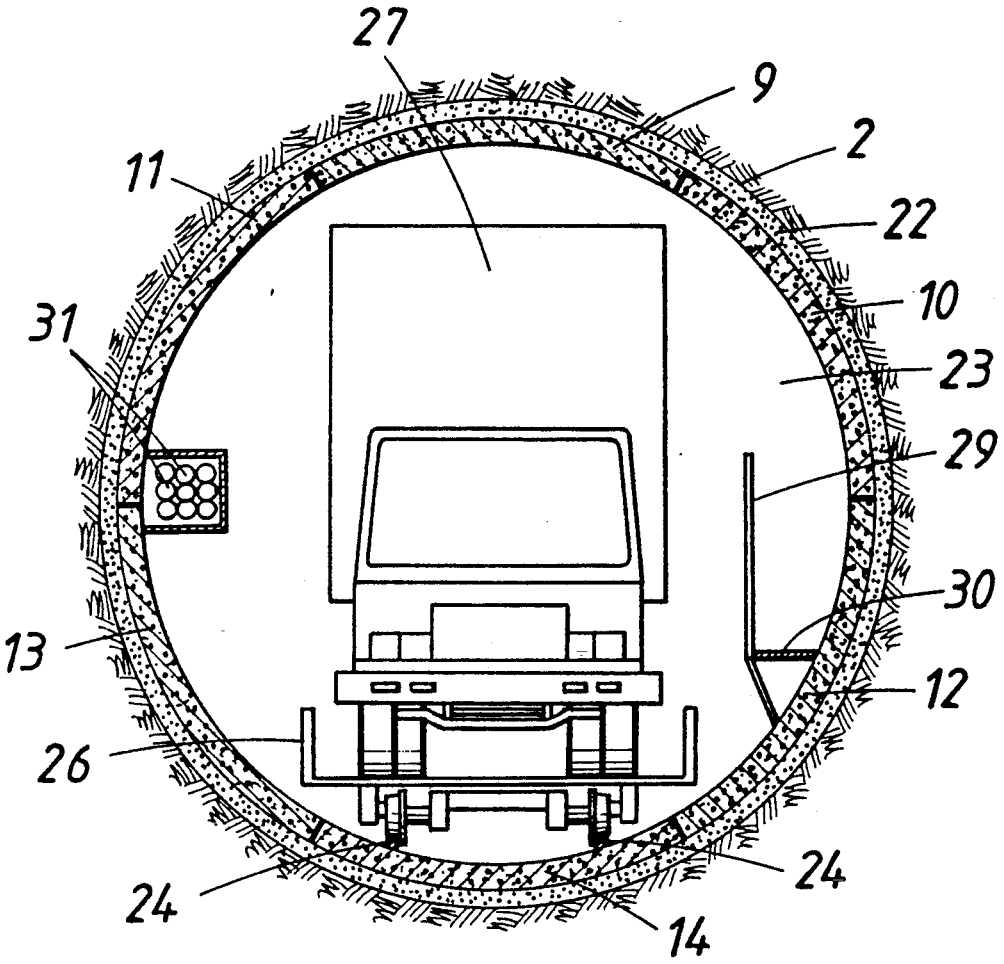

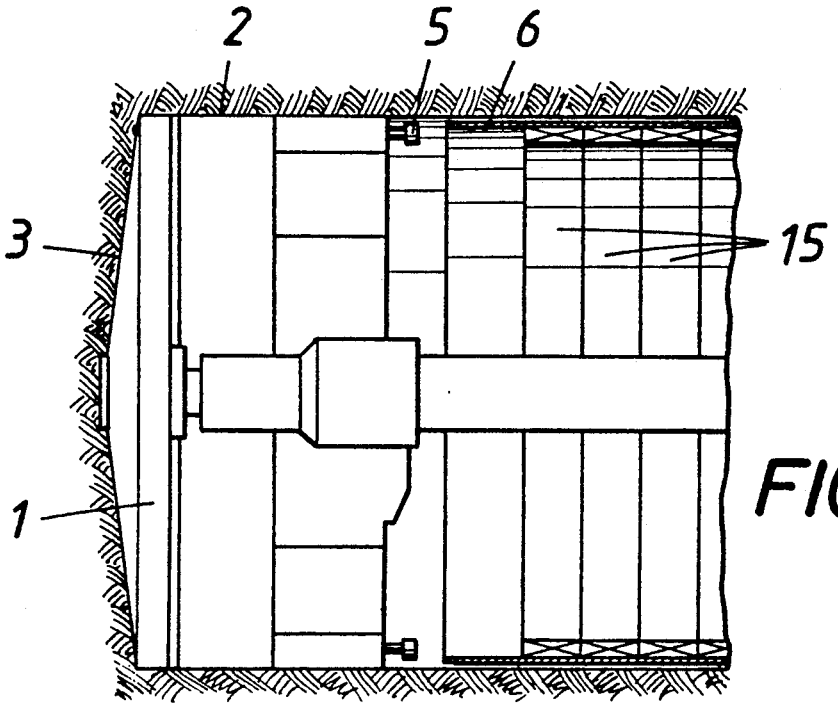
FIG.1
FIG.2
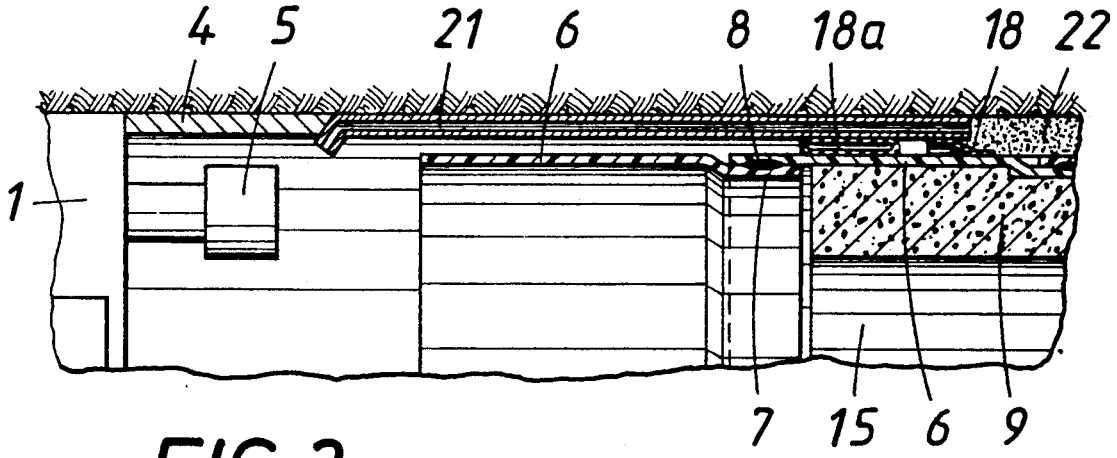
FIG.3
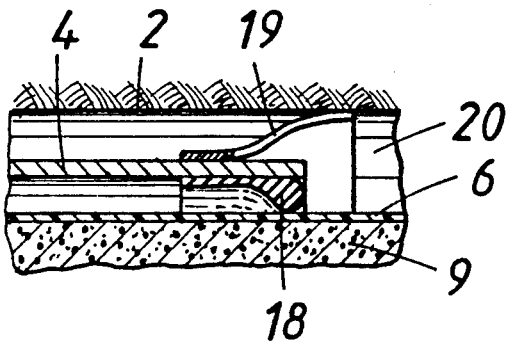
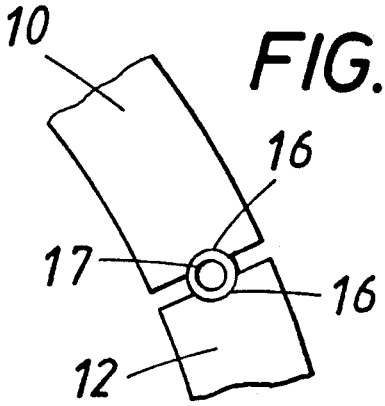
FIG.4

METHOD FOR THE CONSTRUCTION OF LONG TUNNEL WITH A LINING

The invention relates to a new method of constructing long tunnels with a lining. The invention furthermore relates to a tunnel wall made by this new method and includes considerations for a rational operation of the tunnel as well as new tunneling drive means.

"Long" tunnels are understood herein to be tunnels having a length of at least 10 km, especially, however, tunnels that are substantially longer than that and are designed to serve the solution of inter-regional traffic problems, particularly the problem of transit traffic crossing borders. The starting point for the considerations is the planning of a new tunnel road between Southern Bavaria and Northern Italy, the concrete idea being a tunnel receiving the transit traffic with a Northern entry around Rosenheim and a Southern entry in the area of Sterzing or Franzensfeste, which would have a length of about 116 km.

In this concrete case, a long tunnel appears to be the best solution because it would relieve the critical traffic congestions in the Inn Valley, the area around Innsbruck and around the Brenner Pass.

A basic consideration of the invention is the recognition that new ways must be devised in the planning, construction, coordination of the tunnel lining and the operation of such a long tunnel if the tunnel is to be built in an acceptable time at reasonable costs and the operation also is to involve acceptable costs while allowing a high traffic volume.

It is a basic precondition for the above conditions that the tunnel is built with as great a forward thrust speed as possible while maintaining extensive safety conditions and that there is not too long a time interval between the building and completion and its being put in operation. This excludes the conventional tunnel construction as well as the New Austrian Tunnel Construction as a method of construction because, in both cases, rock securing operations are required after the excavation, and the lining completion is possible only thereafter. Building a tunnel with a lining provides a start for a more rational lining of a tunnel with pre-fabricated components. Such a tunnel wall with a lining has been disclosed in Austrian patent No. 389,149, which provides tubbing rings composed of substantially trapezoidal tubbing blocks, groove-spring connections being used between the oblique faces of these tubbing blocks, with springs which are preferably of round cross section and which are also usable as sliding guides for assembling the individual blocks in the rings being inserted in open grooves of the blocks facing each other, and dowels insertable in the blocks being used for connection at the circumferential joint of the rings. The tubbing stones can be connected to each other in a modular assembly system to form the rings and the rings can be connected to each other by dowelling them together, and there is the possibility to obtain deviations of the tunnel lining from a straight line by using tubbing blocks forming tubbing rings enclosing an acute dihedral angle with each other which is defined by the planes of the end faces, two oppositely assembled rings producing a cylinder with parallel end faces while rotation of the rings from this position makes possible deviations of the lining towards the sides and the top and the bottom.

In the construction of tunnels with linings, it is also known to build yielding zones of deformable bodies into the tubbing rings to receive rock deformations. Finally, various types of seals between successive tubbing stones are known by the use of inserted or surface seals.

The primary object of the invention is the provision of a new method which enables long tunnels to be constructed at a high speed of the forward thrust and with substantial completion following the forward thrust. A partial object of the invention is the provision of tunnel linings used for this method as well as new drive means particularly useful for long tunnels and assuring high operational safety.

For constructing a long tunnel with a lining comprising a succession of tubbing rings each comprised of an even number of adjacent and complementary trapeze- or trapezoid-shaped tubbing stones, each tubbing stone having opposite end faces and longitudinally extending oblique side faces, the end faces of the tubbing stones of adjacent ones of the tubbing rings defining an annular gap between the adjacent tubbing rings and the oblique side faces of the adjacent tubbing stones defining longitudinal gaps therebetween, the present invention provides a method comprising the steps of thrusting a tunnel boring machine with a yielding shield mantle and adjacent shield tail against a face of a rock formation to produce an excavation in the rock formation in a manner gentle to the rock formation, constructing the lining continuously as the excavation progresses under the protection of a shield tail by successively assembling the tubbing rings by placing the complementary tubbing stones adjacent each other and inserting yielding elements into the longitudinal gaps between the adjacent tubbing stones, whereby deformations in the rock formation occurring during and after the excavation are first absorbed by the yielding shield mantle and are subsequently absorbed by the yielding elements which cause the tubbing stones of each tubbing ring to yield circumferentially until the rock formation has reached a new equilibrium, and enveloping the tubbing rings in water- and gas-conducting zones of the rock formation with a sealing membrane applied under the protection of the shield tail before the tubbing stones are assembled to form the tubbing rings. Preferably, a material which is compressible to a limited degree is injected at desired zones of the tunnel in an annular gap between the excavated rock formation and the lining to fill the gap whereby the compressible material will absorb long-time deformations of the rock formation and the pressure of the rock formation will be distributed uniformly over the tubbing rings.

A high speed of forward thrust is made possible by providing for the excavation an excavation cross section which barely exceeds the outer cross section of lining of the tunnel. It is decisive for the method of the invention that the weight of the mountain is absorbed by the tunnel boring machine and the mantle of its shield during the excavation and is continuously and yieldingly transferred to the lining so that the excavated area is constantly under the counter-pressure of the tail of the shield and then of the tubbing rings so that loosening is avoided. In this way, a new equilibrium is mostly obtained in small deformation paths and additional safety devices and supports for the rocks, for example anchors, injected concrete, injections, etc., are unnecessary, except in special cases. Of course, if the rock is absolutely firm, it is possible to do without a part of the indicated measures for absorbing long-time deformations in the corresponding sections of the tunnel and one will only seal there where it is necessary. The provided outer sealing affords substantial safety against penetration of gases and liquids and the tunnel lining construction follows the excavation practically immediately so that the tunnel may be fully used for transport purposes up to the point of excavation.

Therefore, access to the tunnel through shafts etc. may be largely omitted and, ideally, such access will be provided only at valley crossings, where the tunnel reaches the surface, or at the connection or widening points required for the supply, the arrangement or the like of the drive means to be operated later and similar tasks. In the final lining construction stage, it is recommended to continue the tunnel tube also in the areas of the line guide, where the tunnel itself reaches the surface or the road runs over the surface, for the sake of the safety of a protected operation.

A satisfactory sealing is obtained by placing a gliding seal between the excavated rock formation and an assembled front tubbing ring enveloped by a respective one of the sealing membranes, and injecting the compressible material into the annular gap up to the gliding seal whereby the pressure of the rock formation is continuously transferred during the thrust of the boring machine from the shield tail to the compressible material and the tubbing rings.

It is a major consideration forming the basis of a further embodiment according to which the tunnel construction is completed with a track installation and electrically driven vehicles movable on the track installation in time with the thrust of the boring machine, that it is advantageous to build the tunnel for rail-bound vehicles since suitably modified rail-bound vehicles pose no problems with respect of the power supply of the drive means as well as a total or partial automation and remote control of the movements so that the available tunnel capacity may be optimally used, on the one hand, and the possibility exists, on the other hand, to drive unmanned through the entire tunnel or substantial portions of the tunnel for transporting goods, that is to guide the goods without personnel and accompanying persons through the tunnel, which makes it possible to do without the very costly and complex safety measures absolutely required for accompanying escort personnel or the transport of persons. As an example of the otherwise required safety measures, escape paths from every point of the tunnel, fire protection measures, large ventilation installations, lighting of the escape paths, etc. may be mentioned.

To reduce the construction time substantially and to obtain nevertheless a substantial adaptation to the given conditions, a road of the tunnel is only approximately predetermined, the rock formation ahead of the boring machine is continuously monitored during the thrust thereof to find dangerous or otherwise problematic rock formation zones, and the thrust of the boring machine and the road of the tunnel is determined on the basis of the findings of the rock formation monitoring while by-passing these zones. If problem zones are recognized in time by sensors by using probes preceding the tunnel boring machine and by continuously making geophysical or seismographic examinations from the boring machine, one may often circumvent such problem zones, be in any case prepared therefor or cut in only in those areas where it is connected with less disturbance or the use of additional safety measures is needed only for short sections.

Altogether, it is recommended to operate by automatically controlling the thrust of the boring machine by the use of electronic sensoring techniques, assembling the tubbing rings by robots, and automatically controlling and coordinating the supply and removal of material through the lining.

With this aimed use of sensing and robotic techniques, maximal automation of the forward thrust and completion with a minimum number of personnel and thus a minimum danger to personnel may be obtained, it being possible to select control programs for the forward thrust and the wall building automatic adapted and responsive to the information received from the sensors so that the relatively most favorable adaptation of these construction stages may be selected for each instantaneous condition. The delivery and removal of the material, particularly the structural parts, on the one hand, and the excavated material, on the other hand, is also coordinated by the control unit and the supervising computer in dependence on the available drive means and the path to be traversed to reach the next loading or unloading point so that the drive means may be optimally utilized and constant supply to, and removal from, the excavation area may be assured.

A tunnel support with a lining construction made according to the method of the invention may use as the yielding elements compressible springs having a circular cross section arranged in longitudinal grooves in the side faces of the tubbing stones, the grooves having a mating cross section to form groove-spring connections holding the adjacent tubbing stones at a distances in the unstressed condition of the springs and permitting the width of the longitudinal gaps to be reduced upon compression of the springs under the pressure of the rock formation through which the tunnel extends. The springs may be tubular. In addition to the available assembly of the tubbing stones to form rings and the rings to form the tunnel tube according to a simple modular construction system, this embodiment has the particular advantage that the springs of the groove-spring connections also constitute the elements necessary for absorbing the portion of the deformation path of the rock apportioned to the tubbing rings, its other portion having been absorbed by the yielding shield mantle, so that more costly necessary equilibrium devices, such as deformation elements mounted in their own housings, may be avoided and the compressible springs may be optionally used in connection with groove sealing bands for additionally sealing the longitudinal grooves at the same time.

In a further embodiment, anchors for a track are installed on the bottom tubbing stones of the tubbing rings, a track is anchored thereto, and rail-bound vehicles are driven along the track by a linear motor drive comprising winding sections fixedly arranged along the track and permanent magnet units associated with the vehicles coupled thereto. The use of a linear motor drive for the rail-bound vehicles has various fundamental advantages compared to the also possible drive of the rail-bound vehicles by electro-locomotives or electrically driven carriages. In the first place, the operational drive capacity may be adapted to the ascending and descending incline of the path and a fully automatic control of the drive means available in the tunnel at any moment is possible, it being possible to lay fixed supply lines to the winding sections of the linear motor so that the problems arising from catenaries and current taps are avoided and the safety precautions required for current-conducting parts are simplified. In addition to the previously mentioned advantages, the main advantage of a linear motor is the possibility to generate drive and braking forces operating on the drive means substantially in the driving direction by the linear motor directly by the permanent magnet units so that relatively light-weight drive means may be used, rather than locomotives which are necessarily very heavy because of the transmission of the driving forces by friction with the rails, i.e. the empty weight/service load ratio is substantially more favorable than in an electric locomotive operation.

Structurally, an embodiment is recommended wherein the permanent magnet units are supported and guided by carriages on lanes associated with the winding sections whereby a substantially constant air gap is maintained therebetween, and the carriages are connected to the vehicles by an entrainment coupling which has a transverse tolerance. This avoids that deviations of the rails from a position parallel to the linear motor, which may be caused by assembly inaccuracies as well as movements of the tunnel tube under the pressure of the rock formation, influence drive movements or that the resilience of the rail-bound vehicle springs influence the magnitude of the air gap or require a large average air gap magnitude resulting in a poor efficiency.

Finally, a further rationalization is obtained by providing separate tunnel tubes of circular cross section for opposite driving directions.

If the cross section of the individual tunnel tubes is equal to the outer peripheries of the drive means provided for the tunnel and/or the goods to be transported through the tunnel, for example truck trains or containers, an internal diameter of about 5.5 m for the tunnel tube is sufficient. The excavation cross section and thus the material removal for two such tunnel tubes is considerably smaller than the excavation cross section of a single tunnel tube which would have to have a diameter of at least 9.5 m if it were to receive two corresponding drive means side-by-side. Furthermore, the operating safety through separate tunnel tubes for the two drive directions is enhanced and the rock formation is much less disturbed by two smaller tunnels than by a large tunnel, the rock pressure in unfavorable areas being decisively smaller on a small tunnel so that substantially weaker tubbing stones may be used in the smaller tunnel.

Further details and advantages of the invention will be gleaned from the following description of the drawing.

The invention is illustrated in the drawing by way of example. Shown is in

Figure 6:
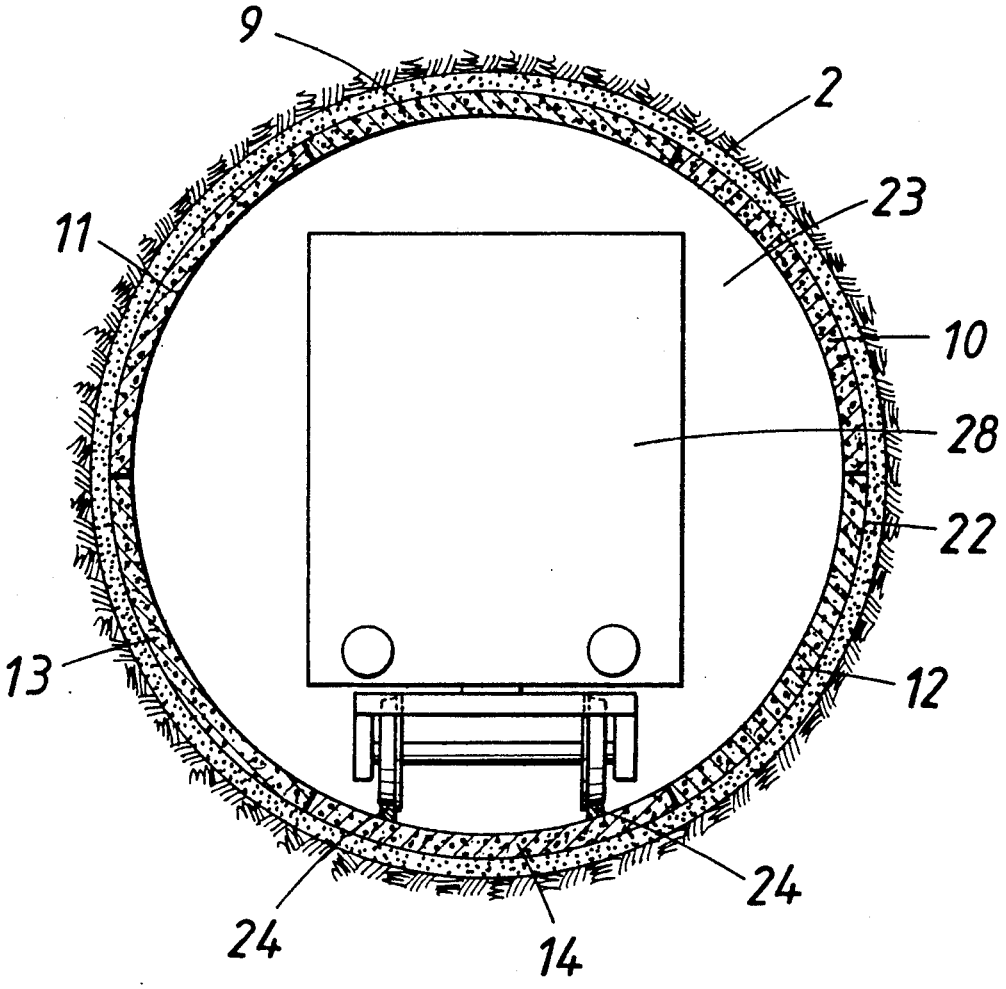
Figure 7:
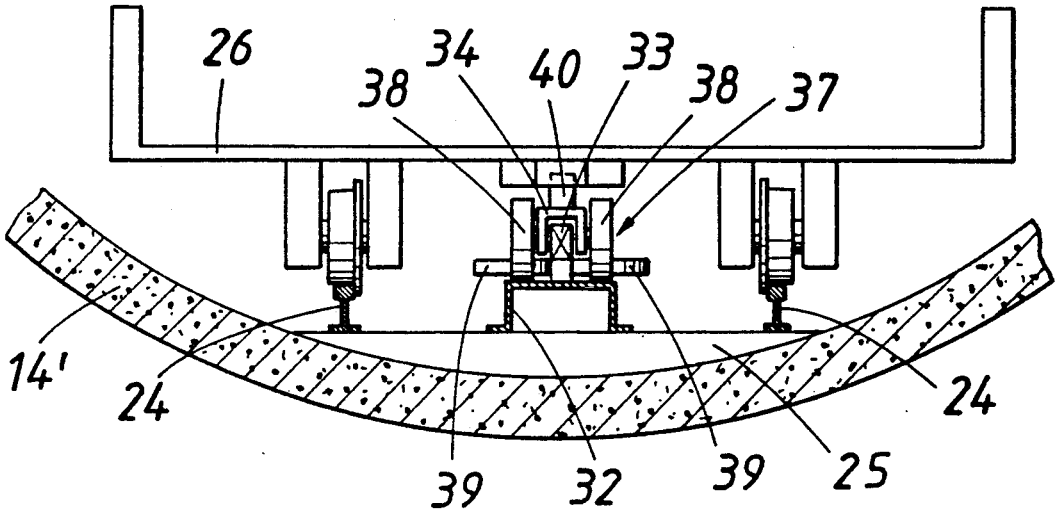
Figure 8:
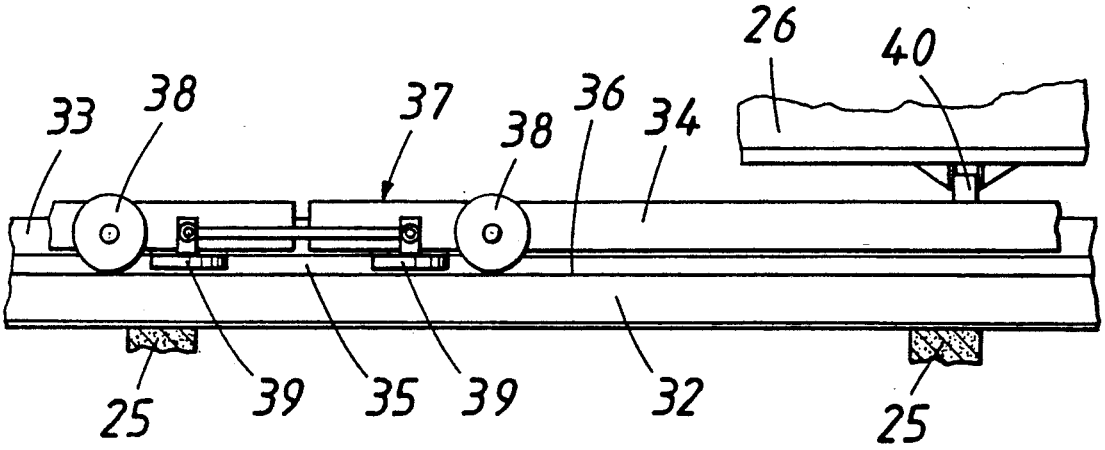

FIG. 1 a tunnel during the forward thrust in a longitudinal section of the excavation area, in a highly schematic illustration, FIG. 2, as a detail of FIG. 1, the shield mantle and shield tail of the tunnel boring machine, FIG. 3, as a detail of FIG. 2, the shield tail end with the seals provided there, FIG. 4 a front view of two interconnected tubbing stones, FIG. 5 a completed tunnel in cross section, with its drive means when a rolling road is used, FIG. 6 another cross section of a tunnel, with a wagon, FIG. 7, as a detail of FIGS. 5 and 6, the bottom of the tunnel tube, with a traction vehicle supported on rails and the linear motor provided therefor, and FIG. 8 a side elevational view of FIG. 7, only the linear motor and the parts of the traction vehicle associated therewith being illustrated.

According to FIGS. 1 to 4, tunnel boring machine 1 is used for the forward thrust of a tunnel excavation 2. Such tunnel boring machines 1 are fundamentally known. They excavate at the face 3 of the tunnel in a combined cutting and excavating stage and convey the excavated material to non-illustrated receiving apparatus, such as conveyor bands and the like, which move this material to pre-disposed vehicles, particularly rail-bound dump trucks. Tunnel boring machine 1 is equipped with a yieldingly constructed shield mantle 4 and an adjacent shield tail which is also yieldingly constructed. Hydraulic presses 5 are mounted on boring machine 1 to generate the forward thrust and also to aid in pressing tubbing stones against previously laid stones or tubbing rings in a manner to be described hereinbelow.

Under the protection of the shield tail, sealing membranes 6 are laid and formed into closed rings, which overlap previously laid membranes 6 in the area of edges 7, 8, in critical excavation areas where there is a potential influx of water or gas. Tubbing stones 9 to 14 are laid in the thus formed gas- and liquid-impermeable envelope, an even number of tubbing stones, six in the illustrated embodiment, completing a closed tubbing ring 15. The tubbing stones have the basic shape of trapezes or trapezoids, the parallel sides of the trapeze-shaped stones forming the end faces of rings 15. Trapezoidal stones are used if the end faces of the rings are to extend in planes enclosing an acute angle so that there is a possibility to deviate the longitudinal axis of the tunnel from a straight line by joining such rings together in different rotational positions.

Like stones 9 to 14 may be used if the stones are trapeze-shaped. Three pairs of like stones are required to form a ring if trapezoidal stones are used. In all cases, a tensile force transmitting plug connection is provided for connecting the end faces of the rings and for connecting a new stone to an existing ring 15, with the use of plugs which engage associated holes in the stones and are pressed in by means of presses 5, and which permit a limited transmission of shearing forces.

For stones 9 to 14 to form ring 15, the stones are provided at the oblique sides with longitudinal grooves which, in the illustrated embodiment, have a semi-circular or segment shaped cross section, and springs 17, which according to FIG. 4 may have a tubular cross section but may also be of solid material wherein optionally a softer core is placed in an outer tubular envelope, are inserted in these longitudinal grooves 15 to produce groove-spring connections.

As FIGS. 2 and 3 show in particular, stones 9 to 14 are assembled into rings 15 within sealing membrane 6 under the protection of shield tail 5 and are joined to previously laid rings 15. Shield tail 5 has a circumferentially extending lip seal 18 as well as optionally (FIG. 2) a ring seal 18*a*, with which it is supported by means of a respective sealing membrane 6 on a completely assembled ring 15, and it may further comprise a brush seal consisting of increments 19 which sealingly engage excavation wall 2. Filling material 22 is pressed into cavity 20 between the membranes and excavation 2 through lines 21 which are laid in or along the shield tail, the material being injected up to seals 18, 19 whereby the pressure of the rock formation is continuously transmitted from the forward thrust machine and the shield tail to the completed tubbing rings 15 and there possibly effects a deformation of springs 17 as tunnel boring machine 1 with shield tail 4 advances. If originally determined gaps between successive stones, for example 10, 12, are closed, later occurring long-time deformations may be compensated by the use of a filling material 22 which is compressible to a certain degree and/or thixotropic, for which purpose outlets leading into cavities of stones 9 to 14 may be provided, through which material may pass when a predetermined excess pressure is reached. The forward thrust of the tunnel boring machine is monitored and controlled by a control unit. Sensors, which indicate any disturbances in the rock, may be used to examine the rock formation ahead of tunnel end wall 3 so that the road guidance may be changed by means of a by-pass. The insertion and assembly of tubbing stones 9 to 14 into tubbing rings 15 is also controlled by the central control unit, assembly robots being preferably utilized for inserting the parts. Most of the other operating procedures, such as the laying of membranes 6, the control of presses 5, the supply of filling material 22 as well as the loading of the excavated material for removal thereof, the removal itself and the delivery of the structural parts for the tunnel tube are also largely automated.

In the illustrated embodiments, it is assumed that two tunnel tubes for the two driving directions are used at least in the completion of the construction. Of course, in an intermediate construction stage, one tunnel tube may be used in an intermittent operation once for one driving direction and then for the other driving direction.

According to FIGS. 5 and 6, completed tunnel tubes 23 are equipped tracks 24 whose supports are mounted directly on tubbing stones 14 forming the bottom stones of tube 23. According to the modified embodiment of FIG. 7, a regular bottom stone 14' is used in the tubbing rings and track 24 is mounted on shaped insertion parts 25 which may traverse several tubbing rings.

FIG. 5 illustrates a deep-loading rail-bound vehicle 26 on which truck trailer 27 is propped. In FIG. 6, a regular wagon 28 runs on track 24. In both instances, the tunnel diameter only slightly exceeds the outer contours of transport units 26, 27 or 28. FIG. 5 further indicates pedestrian path 30 equipped with railing 29 outside the range of the driving path, and ventilating and energy supply lines 31 are indicated to be assembled in a cable shaft 31.

A linear motor drive is preferably used for drive means 26, 28. Such a drive consists in principle of carrier 32 mounted on bottom stone 14 or stone 25 and on which field windings 33 of a linear motor extending in the longitudinal direction of the tunnel are arranged. The drive means are equipped with permanent magnet sets 34 upon which the linear field acts and thus produces the forward movement in the direction of the tunnel. Lanes 35, 36 are arranged adjacent field windings 33 and along their sides, and carriages 37 are supported thereon with running rollers 38, 39 rotatable about horizontal and vertical axes and they guide permanent magnet units 34 along field windings 33 while maintaining a constant air gap. A coupling 40, which permits a vertical and horizontal play, is provided between carriages 37 and vehicle 26 or 28 so that relative displacements of drive means 26, 28 with respect to linear motor 33 is possible.

In deep-loading constructions 26, each individual deep loader may be equipped with a permanent magnet set 34 and thus with its own drive. Forward motion as well as braking forces may be produced by the linear motor. The control is effected externally by central control units. Within a train, only some of the individual drive means 26 may be equipped with permanent magnet sets. For the passage of regular railroad cars through tunnel tubes 23, it will be useful to utilize special traction vehicles which need to have only a reduced weight compared to locomotives since the forward drive is produced by linear motors.

In the illustrated embodiments, a constant and top speed in the range of about 60 to 80 km/h is recommended for the drive means. If higher speeds are used, problems could be encountered in the relatively narrow tunnel tubes 23 because of air turbulence and air displacement by the drive means. If higher speeds are used, it would be necessary to utilize drive means with a closed, streamlined contour, i.e. trucks and container in suitably streamlined wagons interconnected in a train for loading, and/or to provide deflecting devices for the displaced air at short distances from each other, which would considerably increase the cost of the tunnel construction. A possibility would be to build a continuous wall instead of railing 29 in FIG. 5, and to utilize the segmentally divided outer space of the tunnel tube for the reception of the air displaced by the drive means and its recirculation to the rear side of the drive means through spaced holes.

We claim:

1. A method of constructing a long tunnel with a lining comprising a succession of tubbing rings each comprised of an even number of adjacent and complementary trapeze- or trapezoid-shaped tubbing stones, each tubbing stone having opposite end faces and longitudinally extending oblique side faces, the end faces of the tubbing stones of adjacent ones of the tubbing rings defining an annular gap between the adjacent tubbing rings and the oblique side faces of the adjacent tubbing stones defining longitudinal gaps therebetween, which method comprises the steps of (a) thrusting a tunnel boring machine with a yielding shield mantle and adjacent shield tail against a face of a rock formation to produce an excavation in the rock formation in a manner gentle to the rock formation, (b) constructing the lining continuously as the excavation progresses under the protection of a shield tail by successively assembling the tubbing rings by (1) placing the complementary tubbing stones adjacent each other and (2) inserting yielding elements into the longitudinal gaps between the adjacent tubbing stones, (3) whereby deformations in the rock formation occurring during and after the excavation are first absorbed by the yielding shield mantle and are subsequently absorbed by the yielding elements which cause the tubbing stones of each tubbing ring to yield circumferentially until the rock formation has reached a new equilibrium, and (c) enveloping the tubbing rings in water- and gas-conducting zones of the rock formation with a sealing membrane applied under the protection of the shield tail before the tubbing stones are assembled to form the tubbing rings.

2. The tunnel construction method of claim 1, comprising the further step of injecting at desired zones of the tunnel a material which is compressible to a limited degree in an annular gap between the excavated rock formation and the lining to fill the gap whereby the compressible material will absorb long-time deformations of the rock formation and the presence of the rock formation will be distributed uniformly over the tubbing rings.

3. The tunnel construction method of claim 2, wherein the compressible material is thixotropic.

4. The tunnel construction method of claim 2, wherein the compressible material is injected through posts in the shield mantle.

5. The tunnel construction method of claim 2, wherein the compressible material is injected through ports in the tubbing stones.

6. The tunnel construction method of claim 2, comprising the further step of placing a gliding seal between the excavated rock formation and an assembled front tubbing ring enveloped by a respective one of the sealing membranes, and injecting the compressible material into the annular gap up to the gliding seal whereby the pressure of the rock formation is continuously transferred during the thrust of the boring machine from the shield tail to the compressible material and the tubbing rings.

7. The tunnel construction method of claim 2, further comprising the step of completing the tunnel construction with a track installation and electrically driven vehicles movable on the track installation in time with the thrust of the boring machine.

8. The tunnel construction method of claim 1, further comprising the step of completing the tunnel construction with a track installation and electrically driven vehicles movable on the track installation in time with the thrust of the boring machine.

9. The tunnel construction method of claim 1, comprising the further steps of only approximately predetermining a road of the tunnel, continuously monitoring the rock formation ahead of the boring machine during the thrust thereof to find dangerous or otherwise problematic rock formation zones, and determining the thrust of the boring machine and the road of the tunnel on the basis of the findings of the rock formation monitoring while by-passing said zones.

10. The tunnel construction method of claim 2, comprising the further steps of only approximately predetermining a road of the tunnel, continuously monitoring the rock formation ahead of the boring machine during the thrust thereof to find dangerous or otherwise problematic rock formation zones, and determining the thrust of the boring machine and the road of the tunnel on the basis of the findings of the rock formation monitoring while by-passing said zones.

11. The tunnel construction method of claim 1, further comprising the steps of automatically controlling the thrust of the boring machine by the use of electronic sensoring techniques, assembling the tubbing rings by robots, and automatically controlling and coordinating the supply and removal of material through the lining.

12. The tunnel construction method of claim 2, further comprising the steps of automatically controlling the thrust of the boring machine by the use of electronic sensoring techniques, assembling the tubbing rings by robots, and automatically controlling and coordinating the supply and removal of material through the lining.

13. The tunnel construction method of claim 1, wherein the yielding elements are compressible springs having a circular cross section arranged in longitudinal grooves in the side faces of the tubbing stones, the grooves having a mating cross section to form groove-spring connections holding the adjacent tubbing stones at a distances in the unstressed condition of the springs and permitting the width of the longitudinal gaps to be reduced upon compression of the springs under the pressure of the rock formation through which the tunnel extends.

14. The tunnel construction method of claim 1, comprising the steps of installing anchors for a track on the bottom tubbing stones of the tubbing rings, anchoring a track thereto, and driving track-bound work vehicles along the track by a linear motor drive comprising winding sections fixedly arranged along the track and permanent magnet units associated with the work vehicles coupled thereto.

15. The tunnel construction method of claim 14, comprising the further steps of supporting and guiding the permanent magnet units by carriages on lanes associated with the winding sections whereby a substantially constant air gap is maintained therebetween, and connecting the carriages to the vehicles by an entrainment coupling which has a transverse tolerance.

* * * * *